United States Patent [19]

Buck

[11] Patent Number: 4,576,067

[45] Date of Patent: Mar. 18, 1986

[54] JAW ASSEMBLY

[76] Inventor: David A. Buck, 225 Highway 90 East, Broussard, La. 70518

[21] Appl. No.: 623,040

[22] Filed: Jun. 21, 1984

[51] Int. Cl.[4] ..... B25B 13/58

[52] U.S. Cl. ..... 81/185.1; 269/283; 81/421

[58] Field of Search ..... 81/180 B, 180 C, 180 D, 81/186, 421, 422, 423, 424, 57.15–57.21; 294/DIG. 2; 279/123, 1 SJ; 269/282, 284, 280, 279, 283

[56] References Cited

U.S. PATENT DOCUMENTS

| | | | |
|---|---|---|---|
| 3,021,149 | 2/1962 | Griffin | 279/123 |
| 3,023,651 | 3/1962 | Wallace | 81/57.18 |
| 4,315,447 | 2/1982 | Tartaglia et al. | 81/180 B |

FOREIGN PATENT DOCUMENTS

| | | | |
|---|---|---|---|
| 245968 | 4/1912 | Fed. Rep. of Germany | 269/283 |

*Primary Examiner*—James L. Jones, Jr.

*Attorney, Agent, or Firm*—Robert C. Tucker; William David Kiesel

[57] ABSTRACT

A jaw assembly is provided for gripping tubular members, particularly pipes. The assembly comprises a jaw member, which is attachable to a conventional gripping mechanism, and a removable die which is attachable to the jaw member. The jaw member is provided with a concave surface having parallel grooves which are radially spaced over the concave surface. The die is provided with a convex surface conforming to the curvature of the concave surface of the jaw member. The convex surface of the die is provided with splines which are alignable with and matingly insertable within the grooves on the jaw member. The die is also provided with a concave surface conforming to the radial curvature of the pipe or other tubular member to be gripped.

5 Claims, 4 Drawing Figures

JAW ASSEMBLY

BACKGROUND OF THE INVENTION

1. Field of the Invention

This invention relates generally to devices which grip and rotate pipe or hold pipe against rotational forces and, more particularly, to the components of such devices which make contact with the pipe.

2. Prior Art

There are many devices and mechanisms now on the market which are utilized to grip and rotate pipe. Some operate manually, while others are power assisted. In oil and gas drilling operations, it is necessary to grip drill pipe with extremely high compressive forces while applying a high degree of torque in order to break apart threaded pipe connections. In order to develop the desired forces, power tongs have been designed for gripping and rotating pipe. Examples of power tongs may be seen in the following U.S. patents: U.S. Pat. No. 4,290,304; U.S. Pat. No.4,404,876; U.S. Pat. No. 4,082,017; U.S. Pat. No. 4,084,453; U.S. Pat. No. 4,089,240.

As can be seen in the above listed patents, the actual contact with the pipe is accomplished through the use of die inserts which are pressed into some type of jaw member. When the power tong is in operation the die inserts are urged against the drill pipe and torque is applied. Examples of various configurations of die inserts may be found in FIG. 4 of U.S. Pat. No. 4,404,876 (see reference numerals 144,148 and 149), FIG. 5 of U.S. Pat. No. 4,082,017 (see reference numeral 34), and in FIGS. 4 and 5 of U.S. Pat. No. 4,290,304 (see reference numeral 92). As can be seen, the die inserts are relatively narrow in comparison to the jaw members to which they are attached, as well as to the total area of pipe covered by the jaw members. The die inserts are mostly commonly held in place through a dovetail key arrangement. Those die insert configurations illustrated above are virtually a standard in the industry.

Problems have developed with the above mentioned jaw/die configurations. The small wearing surfaces of prior art dies result in tremendous pressures (per unit of area) being applied to the drill pipe. These pressures result in deformation of the pipe, which in turn results in down time and pipe replacement costs. This is especially true in deep water drilling operations, where lightweight pipe must be utilized. Also, as torque is applied, the dovetail keyway of prior art dies will wear due to the small surface area which must bear the torque, necessitating expensive replacement of the entire jaw/die assembly. Because of the small wearing surface of the dies, they are also prone to quickly wear out. The above problems were necessitated by the belief that the die size must remain small in comparison to the jaw member in order to provide the necessary bulk to resist the amount of torque which is applied to the pipe.

SUMMARY OF THE INVENTION

Therefore, it is an object of this invention to provide a jaw assembly which will maintain contact with large surface area of drill pipe or other tubular member, thereby reducing the potential for deformation of the tubular member.

It is a further object of this invention to provide such a jaw assembly which will not damage the jaw member when in use.

It is still another object of this invention to provide such a jaw assembly in which the die is easily and inexpensively replaceable.

Still other objects and advantages of this invention shall become apparent from the ensuing descriptions of the invention.

Accordingly, a jaw assembly for gripping tubular members is provided, comprising a jaw member, which is attachable to a conventional gripping mechanism, and a removable die which is attachable to the jaw member. The jaw member is provided with a concave surface having radially spaced parallel grooves. The die is provided with a corresponding convex surface having splines which are alignable with and matingly insertable within the grooves of the jaw. The die is also provided with a concave surface conforming to the radial curvature of the pipe to be gripped. The splines serve to provide the necessary torque transfer, while additionally securing the die in place, allowing easy die installation and removal, and providing a much larger area of contact with the tubular member to be gripped.

DESCRIPTION AND PREFERRED EMBODIMENTS OF THE INVENTION

Figure 1:
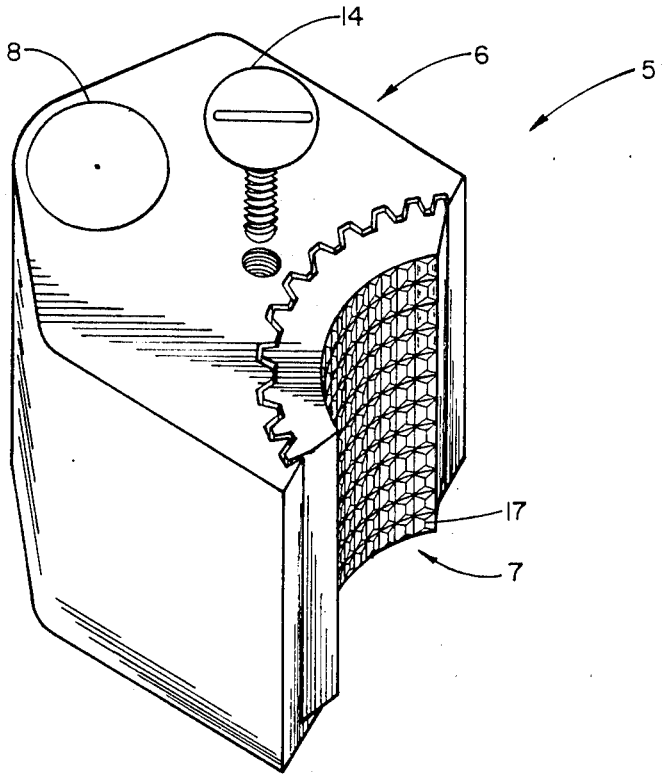
FIG. 1 is a perspective view of the jaw assembly of this invention.

As shown in FIG. 1, the jaw assembly 5 comprises two major pieces—the jaw member 6 and the die 7. The jaw member 6 can be made to accommodate any of several different types of tongs or other pipe gripping devices currently on the market. For example, the jaw 6 shown in the figures is provided with a pin 8 which allows the jaw member 6 to pivot within a set of power tongs. The die 7 is slidably attachable to the jaw member 6. The configuration of the jaw assembly 5 allows for a much larger area of contact when the die 7 is urged against a tubular member 9, such as a drill pipe, eliminating pipe deformation caused by jaw member/-die combinations currently in use.

Figure 2:
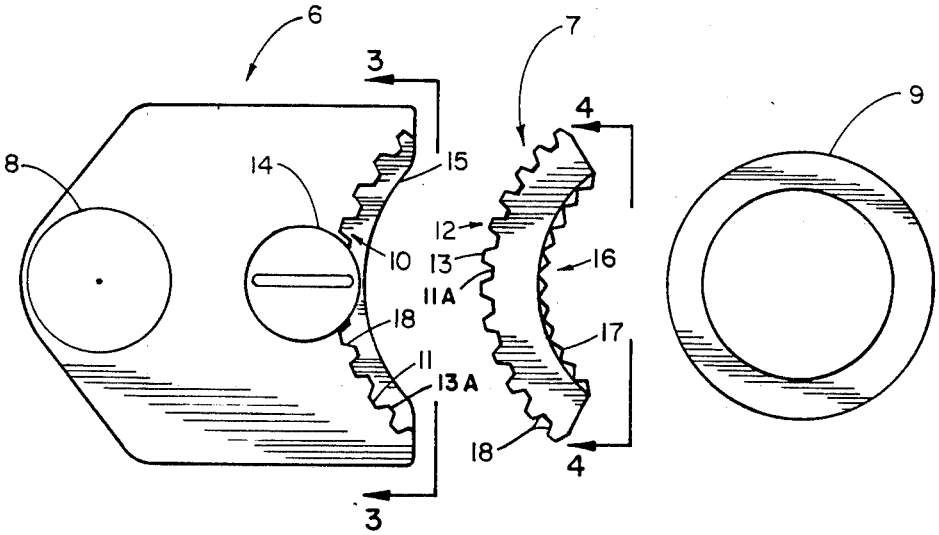
FIG. 2 is an exploded top view of the jaw assembly of this invention.
Figure 3:
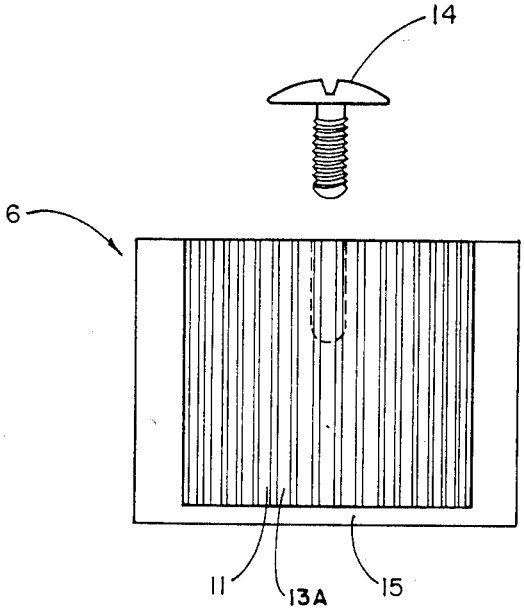
FIG. 3 is a front view of the jaw member of this invention taken along line 3—3 of FIG. 2.
Figure 4:
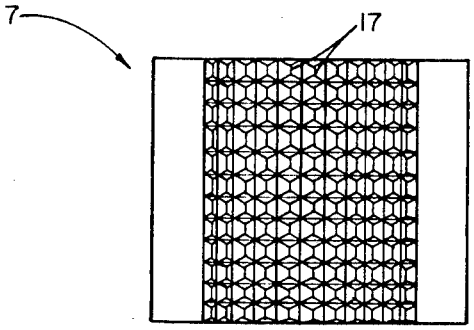
FIG. 4 is a front view of the die of this invention taken along line 4—4 of FIG. 2.

As shown in FIGS. 2 and 3, the jaw member 6 is provided with a concave surface 10, having grooves 11 milled therein. Correspondingly, the die 7 is provided with a convex surface 12, having cogshaped splines 13 milled therein. The splines 13 are milled to matingly slide into the grooves 11 so as to hold the die 7 in place. Correspondingly, on jaw member 6, between grooves 11, splines 13A are provided which matingly mesh with grooves 11A in die 7. As shown in the figures, each spline 13 and 13A extends substantially perpendicular from its respective curved surface 12 and 10, as in a gear. The curvature of surfaces 10 and 12 coupled with the locking effect of splines 13 serve to firmly hold die 7 in position against rotative forces. The spline/groove arrangement provides the necessary torque resistance to prevent excessive wear of the grooves 11,11A or splines 13,13A. The die 7 is held vertically in place by conventional means such as screw 14 and lip 15.

The spline/groove arrangement allows for greatly increased distribution of force over the bearing surface wherein the die 7 contacts the jaw member 6. Whereas the old dovetail or rectangular key arrangement would concentrate the rotative forces on one edge of the die, the present invention provides for a plurality of splines 13,13A which collectively have a comparatively large bearing surface against the grooves 11,11A. The result is that die/jaw member wear is significantly decreased. In a preferred embodiment, shown in the figures, splies 13,13A and grooves 11,11A have tapered sides 18, the taper of each side 18 of a spline 11,11A sloping inward toward a common point, allowing for an even larger bearing surface, while creating a self-adjusting feature. Because of this feature the tapered sides 18 of the grooves 11,11A and splines 13,13A are allowed to slide slightly, relative to each other, allowing the die 7 to firmly seat itself in the jaw 6, assuring a maximum bearing surface area.

The die 7 is provided with a concave wearing surface 16 which conforms to the radial curvature of the pipe 9 to be gripped. The wearing surface 16 may be milled with various patterns of teeth 17 in order to provide additional gripping strength. Thus, as different diameters of pipe 9 are encountered, one need only remove screw 14 and slide in a different die 7. The same procedure is followed to replace a worn die 7.

The use of splines 13,13A to retain and support the die 7 has resulted in a jaw assembly 5 which is more economical to operate and which will not damage lightweight drill pipe. The die 7 may be easily changed without replacing or removing the jaw member 6. The area of contact between die 7 and pipe 9 has been greatly increased over prior art. This increase results in less damage to the pipe 9 as well as decreased die wear and increased tool efficiency. The jaw assembly 5 may be adapted to be utilized with manually operated tools as well as tools which are hydraulically or otherwise operated.

There are, of course, other alternate features and obvious modifications not specifically disclosed, but which are intended to be included within the scope of this invention as defined by the following claims.

I claim:

1. A jaw assembly for gripping tubular members, comprising:

(a) a jaw member, attachable to a gripping mechanism, said jaw member having a concave surface which is provided with a plurality of parallel cog-shaped splines radially spaced over said concave surface, forming parallel cog-shaped grooves between said splines, each said spline extending outward substantially perpendicular from said concave surface.

2. A jaw assembly, as described in claim 1, further comprising:

(b) a die, attachable to said jaw member, and having a convex surface matingly conforming to the curvature of said concave surface of said jaw member, which said convex surface is provided with a plurality of parallel cog-shaped splines forming parallel cog-shaped grooves between said splines, each said spline extending outward substantially perpendicular from said convex surface, said splines being alignable with and matingly and slidably insertable within said grooves of said jaw member, the said splines of said jaw member being alignable with and matingly and slidably insertable within said grooves of said die, said die having a concave surface conforming to the radial curvature of the tubular member to be gripped.

3. A jaw assembly, as described in claim 2 wherein the sides of each said spline of said jaw member and said die are tapered inward toward a common point.

4. A die, attachable to a jaw member, and having a convex surface matingly conforming to the curvature of a concave surface on said jaw member, which said convex surface is provided with a plurality of parallel cog-shaped splines forming parallel cog-shaped grooves between said splines, each said spline extending outward substantially perpendicular from said convex surface, said splines being alignable with and matingly and slidably insertable with parallel grooves in said jaw member, said jaw member having parallel cog-shaped splines being alignable with and matingly and slidably insertable within said grooves of said die, said die having a concave surface conforming to the radial curvature of the tubular member to be gripped.

5. A die, as described in claim 4, wherein the sides of each said spline of said die are tapered inward toward a common point.

* * * * *